US011421938B2

(12) United States Patent
Krieger et al.

(10) Patent No.: US 11,421,938 B2
(45) Date of Patent: Aug. 23, 2022

(54) HEAT EXCHANGER, REFRIGERATION OR HEATING SYSTEM WITH SUCH A HEAT EXCHANGER

(71) Applicant: BITZER Kühlmaschinenbau GmbH, Sindelfingen (DE)

(72) Inventors: Christoph Krieger, Rottenburg (DE); Gabriel Kramp, Stuttgart (DE)

(73) Assignee: BITZER KÜHLMASCHINENBAU GMBH, Sindelfingen (DE)

( * ) Notice: Subject to any disclaimer, the term of this patent is extended or adjusted under 35 U.S.C. 154(b) by 13 days.

(21) Appl. No.: 17/029,305

(22) Filed: Sep. 23, 2020

(65) Prior Publication Data

US 2021/0095928 A1 Apr. 1, 2021

(30) Foreign Application Priority Data

Oct. 1, 2019 (DE) ..... 102019126535.5

(51) Int. Cl.
*F28D 7/16* (2006.01)
*F28F 9/22* (2006.01)

(52) U.S. Cl.
CPC ..... *F28D 7/1646* (2013.01); *F28F 9/22* (2013.01); *F28F 2009/228* (2013.01)

(58) Field of Classification Search
CPC ..... F28D 7/1646; F28F 9/22; F28F 9/228
USPC ..... 165/159, 161
See application file for complete search history.

(56) References Cited

U.S. PATENT DOCUMENTS 1,657,028 A * 1/1928 Nelson ..... F28D 7/1646 165/83
2,384,714 A * 9/1945 Villiger ..... F28F 9/22 165/161
2,693,942 A * 11/1954 Gualajohnr ..... F28F 9/22 165/161
2,919,903 A * 1/1960 Vautrain ..... F28F 9/0239 165/110
3,180,405 A * 4/1965 Hinde ..... F28D 7/1638 165/117

(Continued)

FOREIGN PATENT DOCUMENTS

AT 500881 A1 4/2006
DE 1941717 U 7/1966

(Continued)

OTHER PUBLICATIONS

German Office Action dated Apr. 27, 2020 corresponding to application No. 102019126535.5.

*Primary Examiner* — Devon Russell
(74) *Attorney, Agent, or Firm* — Nath, Goldberg & Meyer; Jerald L. Meyer

(57) ABSTRACT

The present invention relates to a heat exchanger (2) having a jacket (10) through which a first medium (A) can flow and which has at least one first inlet (11) and at least one first outlet (12), at least one tube (30) through which a second medium (B) can flow, the tube (30) being guided through the jacket (10) and having at least one second inlet (31) and at least one second outlet (32), wherein a deflection segment (50) or a plurality of deflection segments (50) are arranged in a row in a longitudinal axis (X) in the jacket (10), wherein the deflection segment (50) is formed from at least two partial sections (51, 52), which are arranged so as to overlap and cross, in areas, transverse to the longitudinal axis (X).

15 Claims, 9 Drawing Sheets

(56) References Cited

U.S. PATENT DOCUMENTS

Figure 1:
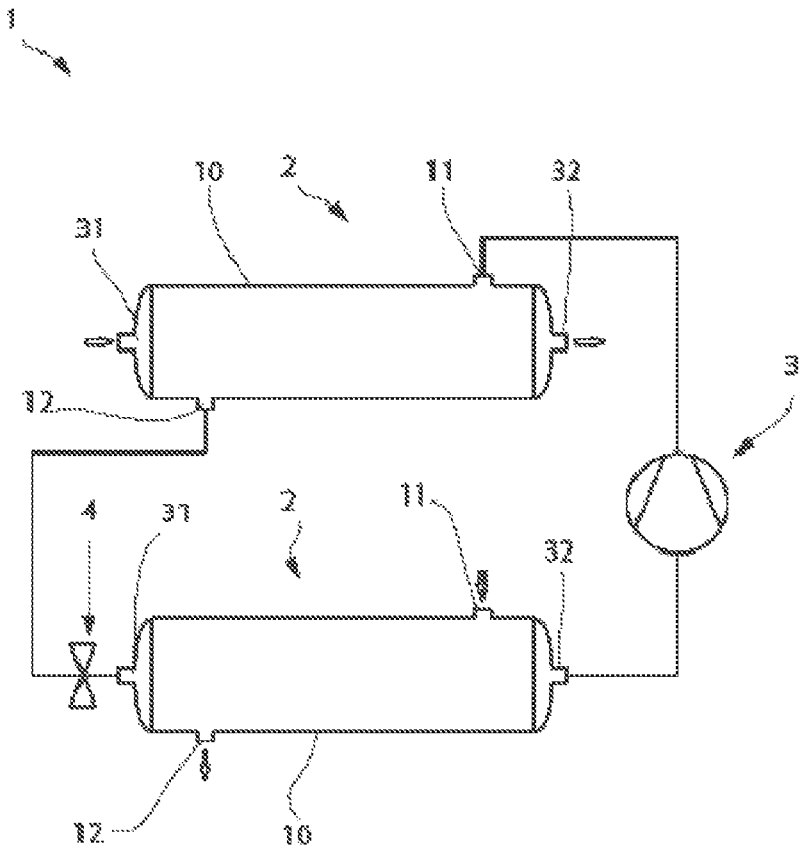

| | | | | |
|---|---|---|---|---|
| 4,127,165 | A * | 11/1978 | Small | F28F 9/0132 165/162 |
| 7,740,057 | B2 * | 6/2010 | Wang | F28D 7/1607 165/161 |
| 2016/0018168 | A1 * | 1/2016 | Urbanski | F28D 7/16 165/159 |
| 2019/0063853 | A1 * | 2/2019 | Tatavarthy | F28D 7/1676 |
| 2020/0378697 | A1 * | 12/2020 | Macedo | F28D 7/16 |

FOREIGN PATENT DOCUMENTS

| | | | |
|---|---|---|---|
| DE | 10349140 | A1 | 5/2005 |
| DE | 102015113501 | A1 | 2/2017 |
| EP | 3081285 | A1 | 10/2016 |

* cited by examiner

HEAT EXCHANGER, REFRIGERATION OR HEATING SYSTEM WITH SUCH A HEAT EXCHANGER

The present invention relates to a heat exchanger with the features of claim 1, as well as a deflection segment with the features of claim 18 and a refrigeration or heating system with the features of claim 19.

Heat exchangers are known from prior art in various configurations and are used to transfer heat between a first medium and a second medium and vice versa. Heat exchangers typically have a jacket, through which the first medium flows, with at least one tube, but often a whole bundle of several tubes inserted in the jacket, through the walls of which heat can be transported from the first medium to the second medium and vice versa.

Heat exchangers are used in refrigeration systems or heating systems as condensers, evaporators, oil coolers or desuperheaters. The first medium can be a refrigerant, which is cooled or liquefied by means of compression in a heat-emitting heat exchanger or, after the expansion process, is evaporated again by the absorption of heat through heating. In many applications it is desirable for a phase transition from vapor to liquid or from liquid to vapor to take place in the heat exchanger, since additional thermal energy in the form of latent heat can be transported by the refrigerant through the phase transition.

In the past, heat exchangers with a circular jacket cross-section that have deflection elements for generating a helical flow around the at least one tube in the jacket space formed by the jacket have proven successful. By means of the deflection elements, the first medium is guided helically or spirally along a flow path through the jacket of the heat exchanger and a flow that rotates around an axis is established. The axis substantially corresponds to a longitudinal axis of a longitudinal extension of the jacket. The helical or spiral flow within the jacket space enables a particularly good heat transfer between the first medium and the at least one tube in the jacket space and, at the same time, enables low pressure loss in the jacket space.

In order to form the helical or spiral flow in the jacket space, various deflection elements are known from prior art, by means of which the desired flow path is imposed on the flow. For example, four deflection elements arranged in the manner of a propeller or a helical structure arranged continuously in the jacket space are known from EP 1 965 165 B1.

Another generic heat exchanger is known from EP 0 117 820 A1. In the jacket space, semicircular deflection elements are arranged along the longitudinal axis in several rows, through which the medium is forced into a spiral flow path.

With this prior art it has proven to be disadvantageous that the known heat exchangers have a relatively high pressure loss with a low power density. In addition, the heat exchangers with deflection elements known from prior art are complex to manufacture and assemble.

This is where the present invention comes in.

It is the object of the present invention to provide an expediently improved heat exchanger which eliminates the disadvantages of known heat exchangers and is easy to manufacture. The heat exchanger should have deflection elements that can be arranged in a space-saving manner and enable a high packing density for the heat-transferring tubes, whereby a high power density with a low pressure loss should be possible.

According to the invention, these objects are achieved with a heat exchanger with the features of claim 1, with a deflection segment with the features of claim 18 and with a refrigeration or heating system with the features of claim 19.

Further advantageous embodiments of the present invention are specified in the dependent claims.

The heat exchanger according to the invention with the features of claim 1 has a jacket, through which a first medium can flow, with a jacket space with at least one first inlet and at least one first outlet and at least one tube through which a second medium can flow, the at least one tube being guided through the jacket space for heat transfer with the first medium and having at least one second inlet and at least one second outlet. The jacket can preferably be hollow cylindrical and surrounds a jacket space, through which the first medium introduced through the at least one first inlet and discharged through the at least one first outlet can flow. The at least one tube is configured to conduct the second medium pressure-tight and leak-free through the jacket space of the jacket and to transfer heat Q between the first medium and the second medium and vice versa. Furthermore, it is provided according to the invention that a deflection segment or a plurality deflection segments is or are arranged in a row along a longitudinal axis in the jacket, each deflection segment being formed from at least two partial sections which, viewed in the longitudinal axis—or transversely to the longitudinal axis—are arranged overlapping in some areas. The longitudinal axis is predetermined by the jacket. By definition, the direction of the longitudinal axis corresponds to the greatest expansion of the jacket, the longitudinal axis being able to form approximately an axis of symmetry of the jacket.

Due to the overlapping arrangement of the at least two partial sections, the flow guidance of the first medium in the jacket is improved, pressure losses are reduced, and the at least one tube is improved for optimal heat transfer.

Here and in the following, an overlapping arrangement of the at least two partial sections is understood to mean an arrangement of the partial sections projected onto the cross-sectional area of the jacket in a plane perpendicular to the longitudinal axis, the projected total area of the at least two partial sections being greater than the cross-sectional area of the jacket, or in other words the projected area of each partial section being greater than half the cross-sectional area of the jacket.

The partial sections are preferably planar and can be made of any material. The partial sections can be made from a weldable material, for example a thermoplastic or metal.

According to a further embodiment of the invention, the at least two partial sections can be fitted together and/or integrally bonded to one another, with a form fit between the two partial sections being realized when the partial sections are fitted together. The integral bond between the at least two partial sections can be produced by welding or gluing or during primary shaping or reshaping. The integral bond between the at least two partial sections can also be formed in an additive process, for example by means of 3D printing. The fitted connection and/or integral bond of the at least two partial sections of the deflection segment makes it possible to form the at least one deflection segment without support structures, so that the jacket space can be optimally used to increase the power density.

According to a further embodiment of the present invention, it is provided that the partial sections of a deflection segment intersect in a first mating area and that the first mating area is formed by a recess in at least one of the at least two partial sections. The first mating area can also be referred to as an intersection area. All partial sections preferably have a recess which correspond to each other and preferably have the same shape. When they are fitted together, this results in a symmetrical configuration of the overlap of the at least two partial sections beyond the recess.

Furthermore, it has proven to be advantageous if the first mating area is arranged on the longitudinal axis. In particular, it has proven to be advantageous if the mating area is formed along a pivot axis which is oriented orthogonally to the longitudinal axis and can intersect the longitudinal axis.

According to a further embodiment of the present invention, the partial sections intersect in the pivot axis orthogonally to the longitudinal axis. For this purpose, the two partial sections are pivoted from a plane perpendicular to the longitudinal axis about the pivot axis in opposite directions, so that they intersect in the pivot axis. An angle $\alpha$ is established between the two partial sections on both sides of the plane, wherein the following applies to the angle $\alpha$: $10° \leq \alpha \leq 150°$. It is particularly preferred if the angle $\alpha$ is approximately $30° \leq \alpha \leq 90°$, since it has been found that a high power density of the heat exchanger can be achieved in this angle range and pressure losses are low.

Furthermore, it has proven to be advantageous if the recess forms an angle stop which defines the angle $\alpha$. When producing a deflection segment, the at least two partial sections can first be fitted together and then pivoted relative to one another about the pivot axis. When the angle $\alpha$ is reached, the respective partial sections strike against the angle stop of the other partial section, which is formed from an edge region of the recess.

A further development of the heat exchanger provides that the angle $\alpha$ of at least two deflection segments is dimensioned differently in a row of deflection segments. In particular, it is preferred if the angle $\alpha$ increases or decreases along the longitudinal axis between the first inlet and the first outlet. By changing the angle $\alpha$ along the longitudinal axis, the flow channel through which the first medium flows can be widened or tapered and there is, for example, the possibility of taking into account changes in density of the first medium along the flow path in order to keep the flow velocity of the first medium along the helical flow path between the first inlet and the first outlet approximately constant.

It has also proven to be advantageous if the at least two partial sections overlap with a degree of overlap, the degree of overlap being at least 1 mm and not greater than half of a distance between diametrical sides transverse to the longitudinal axis of the jacket. In the case of a jacket with a circular-cylindrical cross section, this distance is the diameter. Thus, the degree of overlap should be equal to or smaller than half the diameter. The degree of overlap describes the mean value at which the at least two partial sections of the deflection segment overlap, the degree of overlap being measured parallel to the pivot axis.

In accordance with the present invention, each partial section can be a partial section of an ellipse or an oval. In particular, it is preferred if each partial section is made from a planar starting material. The circumferential side surfaces of each partial section can be perpendicular to a main surface of the planar segment, as a result of which the production method can be designed particularly efficiently and cost-effectively.

It can also be advantageous, in particular with regard to the production method, if the at least two partial sections of a deflection segment are designed to be identical or mirror-symmetrical. The respective partial sections can be provided by an identical manufacturing process, whereby both cost structures and the design of the manufacturing processes can be optimized.

It has furthermore proven to be advantageous if each partial section has a cut-out which is adapted to the at least one tube and through which the at least one tube can be passed. In particular, it has proven to be advantageous if the cut-out has an elliptical or oval shape which has a circular surface projected parallel to the longitudinal axis. The side surfaces of the cut-out can be formed perpendicular to the main surface of the partial section.

A further advantageous embodiment of the invention provides that two deflection segments adjacent in a row are connected to one another. The partial sections of two deflection segments adjacent in the row preferably intersect in a second mating area, the second mating area being formed by a second recess which is formed in at least one of the at least two partial sections of at least one deflection segment. As a result, two adjacent deflection segments can be connected to one another by being fitted together in a manner analogous to the two partial sections of a deflection segment, and a dimensionally stable cage can be formed from a plurality of deflection segments.

According to a further embodiment of the present invention, the jacket can have a distributor cover, deflector cover and/or a collector cover at one end area. The collector cover connects the at least one first inlet and the at least one first outlet to the at least one tube. Collector and distributor covers can also be designed as combined covers, with a corresponding subdivision being required in the combined cover. The deflector cover connects two spaced-apart tubes and enables the direction of flow to be reversed. The second medium can flow through the tubes by means of one or more deflector covers in more than one "pass", wherein the number should preferably be even if there is more than one pass. The deflector covers can also have a combined design and be subdivided into several areas that enable successive deflections. By means of separated areas, combined distributor, deflector and collector covers realize the function of a distributor cover, a collector cover and the function of a deflector cover in one. The at least one tube can also be U-shaped, with no deflector cover being required in this embodiment, but the flow reversal being achieved by a tube bend.

In addition, it has proven to be advantageous if the at least one first inlet of the jacket is oriented transverse to the longitudinal axis and the at least one first inlet opens out between the at least two partial sections of a deflection segment, in particular centrally between the at least two partial sections of a deflection segment. In the event that a plurality of deflection segments are arranged in a row along the longitudinal axis, it is preferred that the at least one first inlet opens out between the at least two partial sections of a first deflection segment in the row. It is particularly preferred if the at least one first inlet is oriented not only transverse to the longitudinal axis, but also transverse to the pivot axis.

Furthermore, it is advantageous if a baffle element is arranged between the longitudinal axis and the at least one first inlet, the normal vector of a normal plane preferably pointing to the first inlet. However, the baffle element can also be arranged inclined between the longitudinal axis and the at least one first inlet, in order to deflect the entering first medium. In particular, it is preferred if the baffle element is arranged between the at least one tube and the first inlet. The baffle element can be designed as a baffle plate and avoids wear of the at least one tube. The baffle element also serves to divide the first medium entering through the at least one first inlet into a first flow path and a second flow path. The first flow path and the second flow path are forced into a helical or spiral course by the at least one deflection segment, whereby a double-helical flow arises.

According to a further embodiment of the present invention, it has been found to be advantageous if the baffle element is diamond-shaped in a normal plane, so that the flow is distributed in different directions in the jacket space when the first medium hits the baffle element. In addition, this can reduce pressure loss. The baffle element can also be designed as a 3D baffle element and have a 3D shape for flow-optimized deflection for dividing the first medium entering through the at least one first inlet into a first flow path and into a second flow path on the side facing the inlet. The 3D shape can, for example, be a wedge, a cone, a pyramid, or the like.

Furthermore, it has proven to be advantageous if the partial sections of a deflection segment and/or the partial sections in a row of adjacent deflection segments are rigidly connected to one another. In particular, it is preferred if the partial sections are made from a weldable material and can be rigidly connected to one another by means of welding. Thermoplastic materials can also be used, wherein the partial sections do not necessarily have to be rigidly connected to one another through welding, regardless of the material, but other options are also possible through integral bonding and/or non-positive and/or positive connections such as gluing, clamps, screws, rivets or the like. The partial sections of a deflection segment and/or the partial sections in a row of adjacent deflection segments can also be formed together in one piece and, for example, produced by an additive method.

According to a further advantageous embodiment of the present invention, it can prove to be advantageous if the at least one tube has an enlarged surface, in particular a surface enlarged by ribs or knobs. Due to the enlarged surface, the area made available for the heat transfer is increased on the one hand, and the degree of turbulence of the second medium flowing around is increased on the other hand, as a result of which the heat transfer can be further increased.

In addition, the present invention relates to a deflection segment for a heat exchanger, each deflection segment being formed from at least two partial sections which are arranged overlapping at least in some areas transversely to a longitudinal axis, and wherein the at least two partial sections are crossed transversely to the longitudinal axis and can be fitted together or crossed and integrally bonded.

Another aspect of the present invention relates to a refrigeration or heating system with at least one heat exchanger according to the invention.

Figure 2:
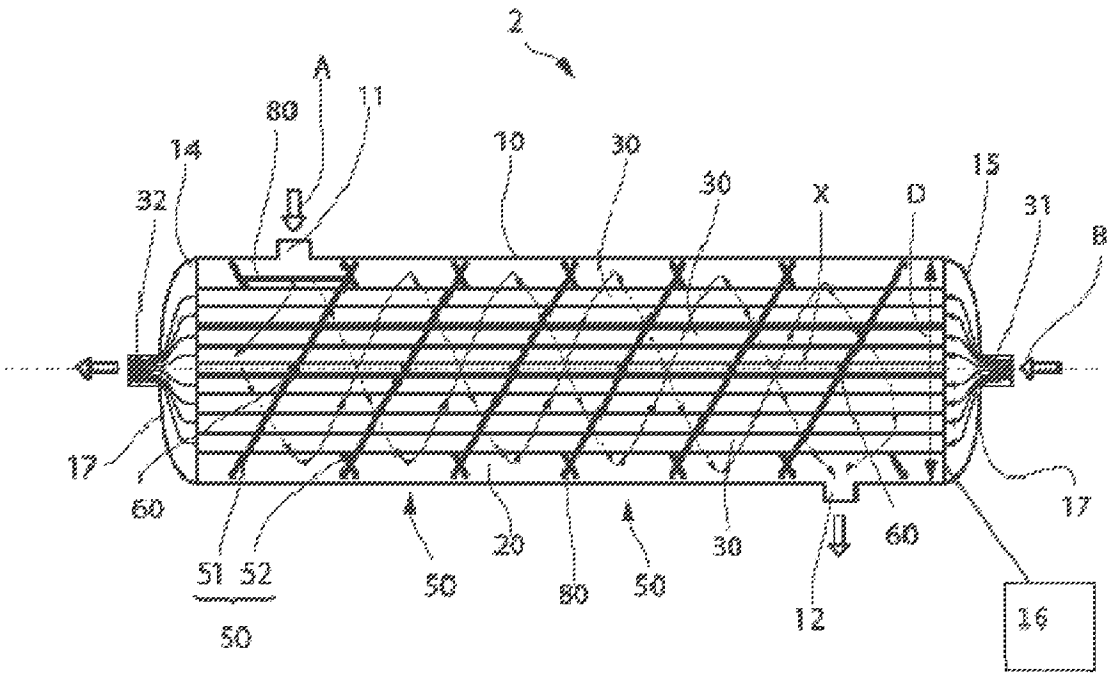
Figure 3:
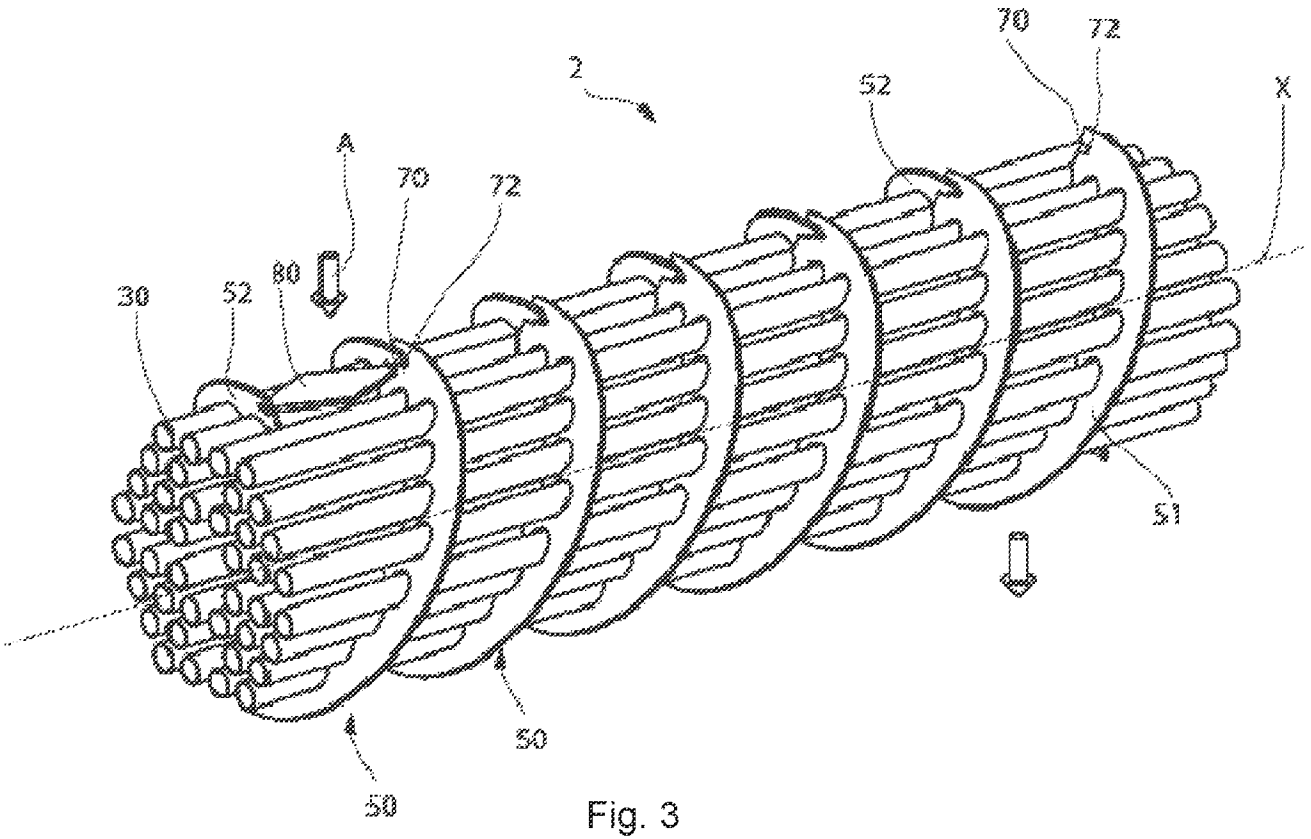
Figure 4:
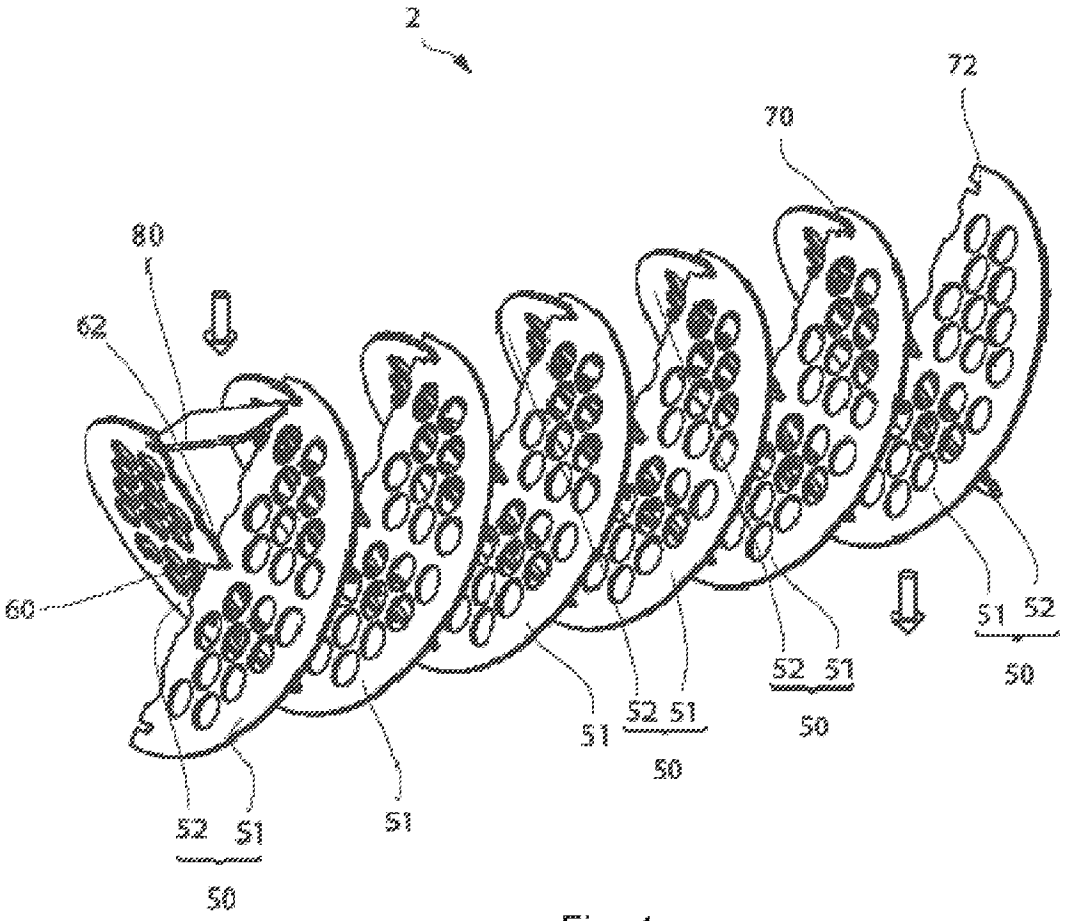
Figure 5:
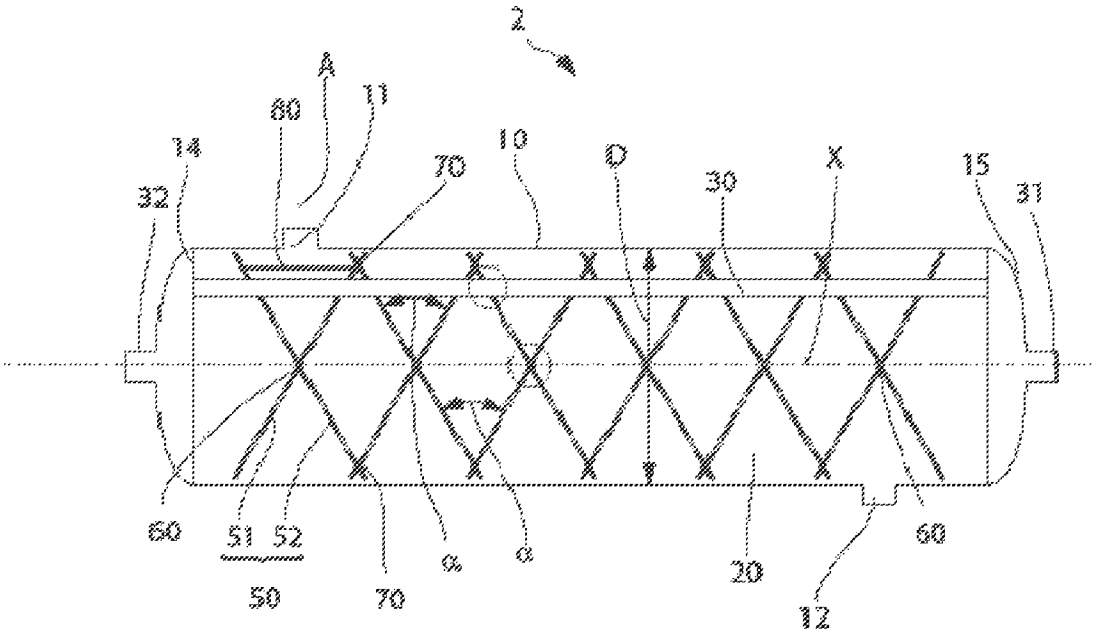
Figure 6B:
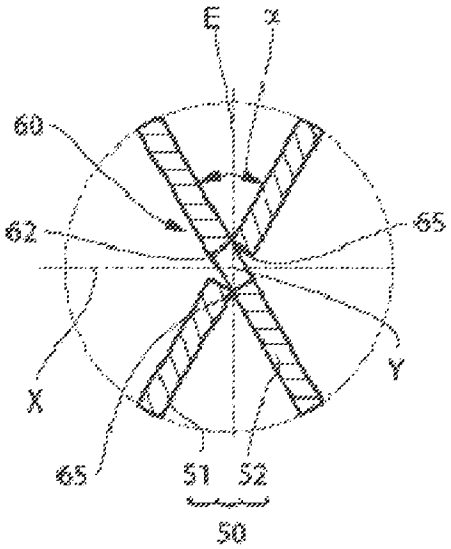
Figure 6A:
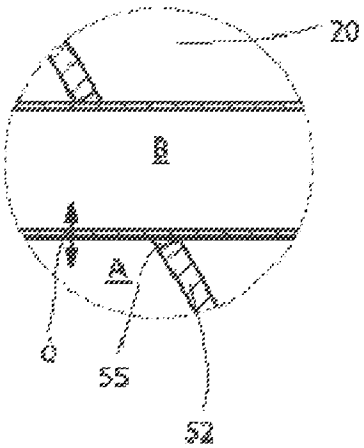
Figure 7B:
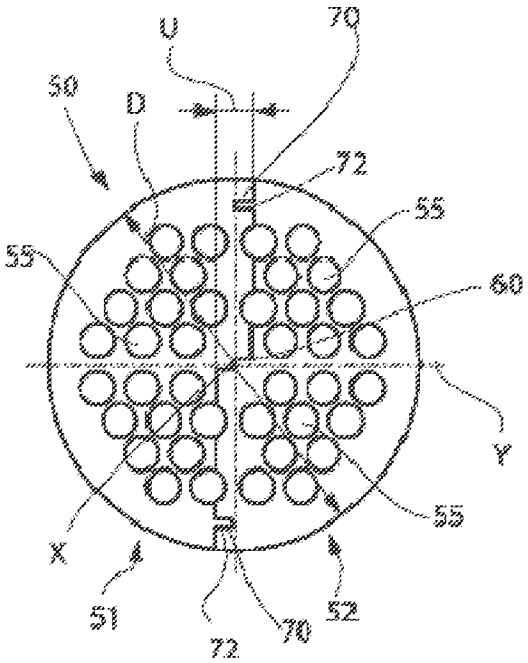
Figure 7A:
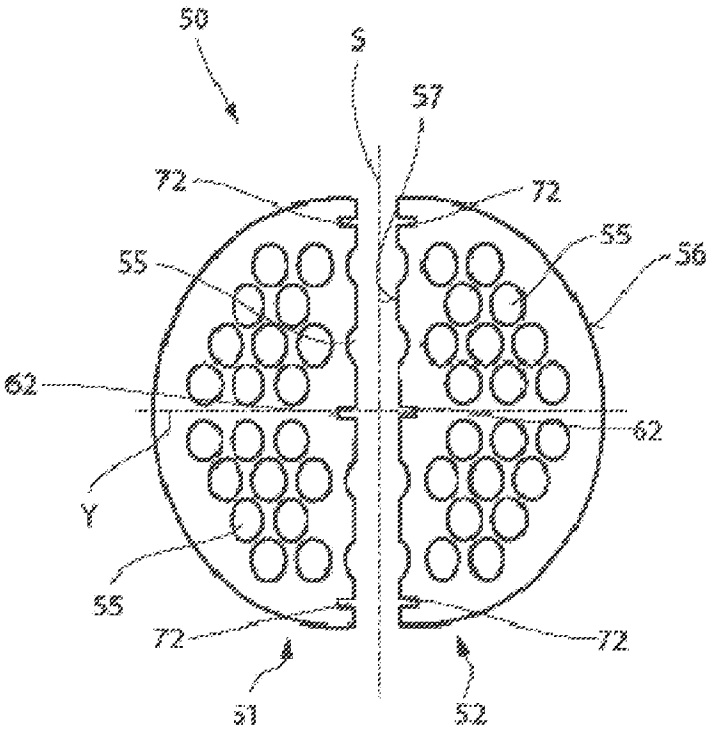
Figure 8A:
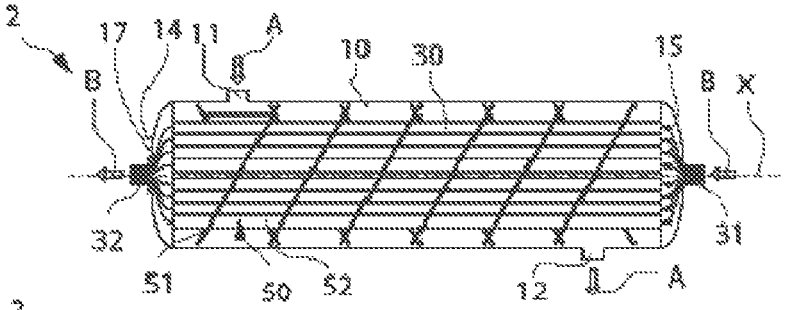
Figure 8B:
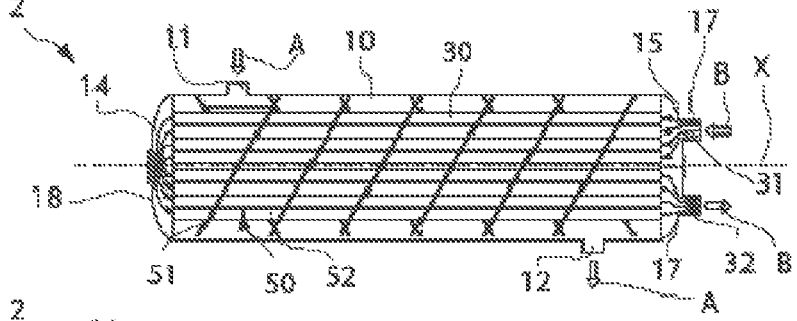
Figure 8C:
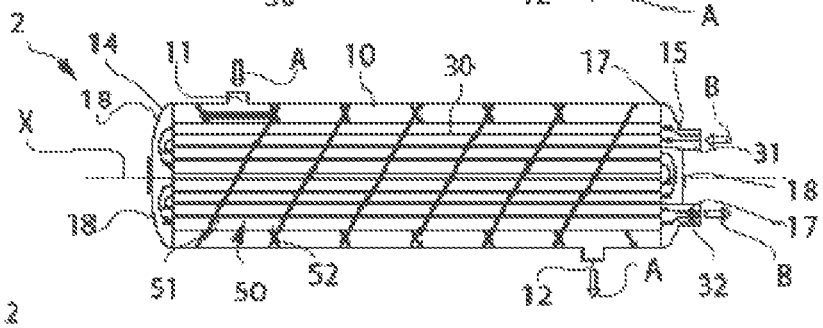
Figure 8D:
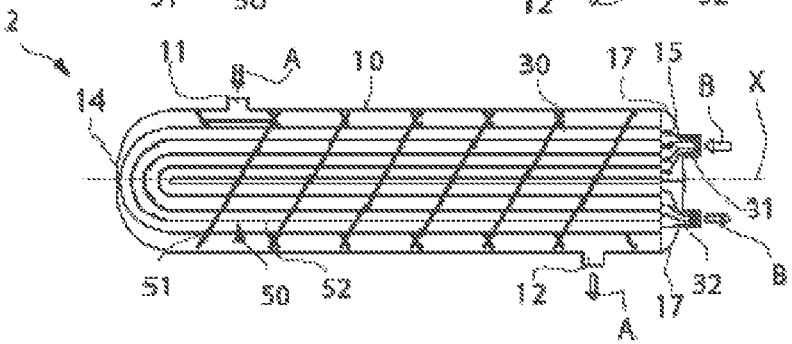
Figure 9A:
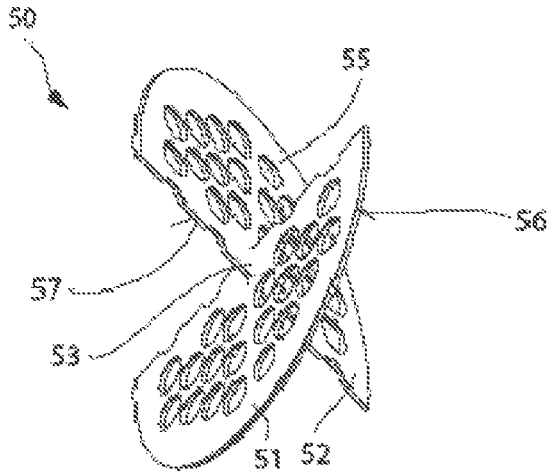
Figure 9B:
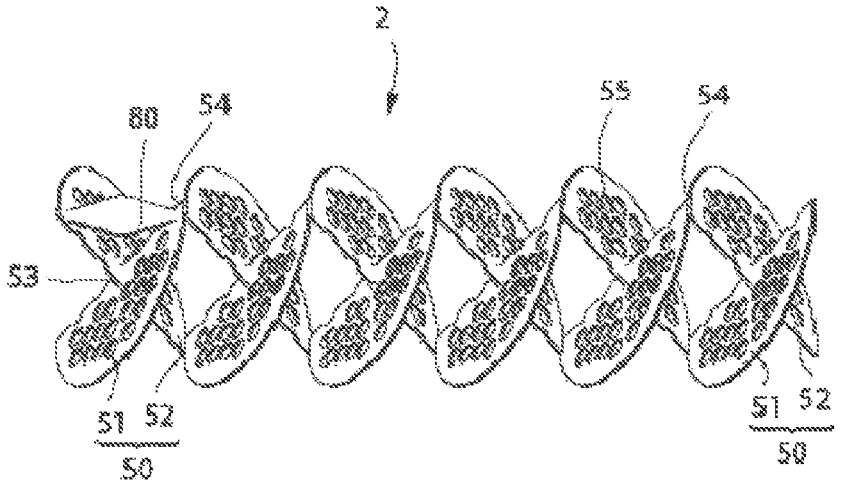

An embodiment of the heat exchanger according to the invention and three further developments thereof are described in detail below with reference to the accompanying drawings. In the drawings:

FIG. 1 shows a schematic and greatly simplified refrigeration system with two heat exchangers, a compressor and an expansion element, FIG. 2 shows a schematic sectional view of one of the heat exchangers according to FIG. 1, the heat exchanger having a jacket space formed by a jacket, in which deflection segments and a single tube or a bundle of several tubes are arranged, FIG. 3 shows a simplified perspective illustration of the components arranged in the jacket space, FIG. 4 shows a simplified perspective illustration of the deflection segments arranged in a row, which are each formed from a first partial section and a second partial section, FIG. 5 is a schematic sectional view of the heat exchanger according to FIG. 2, FIG. 6*a* shows a detailed representation according to FIG. 5, FIG. 6*b* shows a second detailed representation according to FIG. 5, FIG. 7*a* shows a plan view of the first partial section and the second partial section, FIG. 7*b* shows a view in direction X of a deflection segment which is formed by fitting together and pivoting the first and second partial section according to FIG. 7*a*, FIGS. 8*a-d* are sectional views of further developments of the heat exchanger according to the invention, FIG. 9*a* shows a simplified perspective illustration of a further development of an integrally formed deflection segment, and FIG. 9*b* shows a simplified perspective illustration of a deflection segment according to FIG. 9*a* arranged in a row.

Identical or functionally identical components are identified with the same reference symbols. In addition, not all identical or functionally identical components are provided with a reference number in the Figures.

FIG. 1 shows a refrigeration system 1, having a compressor 3, two heat exchangers 2 and an expansion element 4. The medium coming from the compressor 3 is guided to a first heat exchanger 2 and liquefied by emitting heat. The medium is then guided via an expansion element 4 to the second heat exchanger 2, with the heat from a second medium B to be cooled being able to be absorbed by the first medium A in the second heat exchanger 2, whereby the medium A of the refrigeration cycle evaporates again and is sucked in by the compressor for renewed compression 3.

The heat exchanger 2 can be used both in the refrigeration system shown in FIG. 1 and in a heating system—also called a heat pump. The heat exchanger 2 can also be used to desuperheat oil or other liquid or gaseous media, wherein the relevant medium can also undergo a phase change from liquid to vapor and vice versa in the heat exchanger 2.

The sectional illustration according to FIG. 2 shows that the heat exchanger 2 has a jacket 10 with a first inlet 11 and a first outlet 12. The jacket 10 defines a longitudinal axis X and is thus arranged coaxially with respect to it. In the illustrated embodiment, the jacket 10 is substantially hollow and circular-cylindrical with an inner diameter D. In addition, the jacket 10 has a first end area 14 and a second end area 15, the jacket space 20 formed by the jacket 10 being closed at the end areas 14, 15.

A first medium A can be introduced into the jacket 10 or its jacket space 20 through the first inlet 11 and exit again through the first outlet 12, it being possible to for the first inlet 11 to be arranged adjacent to the first end area 14 and the first outlet 12 to be arranged adjacent to the second end area 15. The first inlet 11 and the first outlet 12 can be arranged on diametrical sides of the jacket 10.

Furthermore, the heat exchanger 2 comprises a bundle, formed from a plurality of tubes 30, which are guided through the jacket 10 or the jacket space 20 parallel to the longitudinal axis X and extend between the first end area 14 and the second end area 15. Each tube 30 is connected to a second inlet 31 and a second outlet 32 and a second medium B can flow through it. Each tube 30 is configured to separate the first medium A in the jacket space 20 from the second medium B in the relevant tube 30 and to transfer a heat flow $\dot{Q}$ through the wall of the tube 30 between the two media A, B. The two directions in which the heat flow $\dot{Q}$ can develop are shown symbolically in FIG. 6*a* by means of a double arrow line.

The first inlet 11 and the second inlet 31 as well as the first outlet 12 and the second outlet 32 can also be arranged on diametrical sides of the jacket 10, whereby the heat exchanger 2 guides the first medium A and the second medium B in opposite directions along the longitudinal axis X past each other according to the counterflow principle.

Each tube 30 opens in the first end area 14 and in the second end area 15 in a distributor or collector cover 17 which, depending on the direction of flow of the medium B, distributes the second medium B from the second inlet 31 to the tubes 30 or collects the second medium B from the bundle of tubes 30 and guides it to the second outlet 32.

The jacket 10 or the jacket space 20 is closed in the first end area 14 and in the second end area 15 in each case by a tube base 16, whereby the second medium B in the distributor or collector cover 17 is separated from the first medium A in the jacket space 20. The tubes 30 can penetrate the tube bases 16 and are connected to them, for example, by welding, soldering, crimping or gluing.

The second inlet 31 is arranged at the second end area 15 and the second outlet 32 is arranged at the first end area 14. For a better understanding the individual flow paths of the first medium A and of the second medium B are shown in FIG. 2 by means of arrow lines.

A plurality of deflection segments 50 are arranged in a row along the longitudinal axis X in the jacket space 20. Each deflection segment 50 consists of at least one first partial section 51 and one second partial section 52, which are arranged overlapping at least in some areas transversely to the longitudinal axis X and are arranged crossed in a pivot axis Y transversely to the longitudinal axis X. In this embodiment, the first partial section 51 and the second partial section 52 are crossed in the pivot axis Y transversely to the longitudinal axis X and are arranged so as to fit into one another. Both the first partial section 51 and the second partial section 52 as well as the adjacent deflection segments 50 are connected to one another and form a cage—as will be explained in more detail below.

The tubes 30 are guided through cut-outs 55 in the deflection segments 50, the cut-outs 55 being adapted to the size of the tubes 30 and encompassing them at least in some areas.

It can be seen from the perspective representations in FIGS. 3 and 4 that the row of deflection segments 50 forms the helical or spiral cage. The first medium A flowing in through the first inlet 11 is guided through the cage along helical or spiral flow paths from the first inlet 11 to the first outlet 12.

The first inlet 11 is directed perpendicularly to the longitudinal axis X and is furthermore preferably arranged in the longitudinal axis X in the center of a deflection segment 50. Between the longitudinal axis X and the first inlet 11, a baffle element 80 designed as a baffle plate is arranged with a normal plane. The normal vector of the normal plane points to the first inlet 11, as a result of which the first medium A flowing in through the first inlet 11 hits the baffle element 80 and is divided into two flow paths—see FIG. 2—to form a double helix.

The first partial section 51 and the second partial section 52 intersect in a first mating area 60 which is arranged on the pivot axis Y. Each first mating area 60 is formed—as shown in particular in FIGS. 6*a* to 7*b*—by a recess 62 both in the first partial section 51 and in the second partial section 52. The two recesses 62 of the first partial section 51 and of the second partial section 52 correspond to one another in shape and position and are taken out of the respective partial sections 51, 52 in the shape of a cuboid.

The partial sections 51, 52 are planar—preferably made of a weldable plastic or a metal—and in FIG. 7*a* lie mirror-symmetrically to a line of symmetry S in a common plane. It can be seen from this illustration that the first partial section 51 and the second partial section 52 can be constructed identically.

Each partial section 51, 52 is formed from a partial section of an oval or an ellipse and has an arcuate section 56 and a secant section 57. The arc length of the arcuate section 56 is greater than 0.5 times the circumference of the oval or ellipse. Furthermore, the cut-outs 55 are incorporated or molded into the partial sections 51, 52, the cut-outs 55 also being oval or elliptical.

It can also be seen from FIGS. 7*a* and 7*b* that the partial sections 51, 52 each have two second recesses 72. The second recesses 72 are arranged symmetrically around the recess 62 in the secant section 57, the recess 62 being arranged in the center of the secant section 57. The distance between the recess 62 and the respective second recesses 72 is preferably 0.4 to 0.5 times the total length of the secant section 57.

A view in direction X of the assembled deflection segment 50 is shown in FIG. 7*b*. The recesses 62 of the two partial sections 51, 52 engage around the other partial section 51, 52, as a result of which the partial sections 51, 52—as seen in the longitudinal axis X—overlap with a degree of overlap U in some areas. The degree of overlap U describes the mean distance between the secant sections 57 of the two partial sections 51, 52, the degree of overlap U being measured parallel to the pivot axis Y. The degree of overlap U thus indicates the degree by which the at least two partial sections 51, 52 of the deflection segment 50 overlap or cover each other. The degree of overlap U is greater than 1 mm and should be less than or equal to D/2. The following applies to the degree of overlap U: $1\ \text{mm} \leq U \leq D/2$.

When the two partial sections 51, 52 are fitted together, the edge areas of the recesses 62 form an angle stop 65 which can specify an angle $\alpha$ at which the first partial section 51 and the second partial section 52 intersect in the pivot axis Y. The angle $\alpha$, see FIG. 6*b*, is established between the two partial sections 51, 52 on both sides about a plane E which is arranged perpendicular to the longitudinal axis X and in the pivot axis Y. The following applies to the angle $\alpha$: $10° \leq \alpha \leq 150°$ and preferably $30° \leq \alpha \leq 90$.

The second recesses 72 are designed analogously to the recesses 62 and form the aforementioned connection between two adjacent deflection segments 50 in a second mating area 70. The baffle element 80 described above can be attached to the second recesses 72 in the mating area 70 and support the deflection segment 50.

The side surfaces of the arcuate section 56, the secant section 57, the recesses 62, the second recesses 72 and/or the cut-outs 55 can be formed orthogonally to the main surfaces of the partial sections 51, 52.

In the first mating area 60, the first partial section 51 and the second partial section 52 can be rigidly connected to one another and/or, in the second mating area 70, adjacent deflection segments 50 can be rigidly connected to one another. For the rigid connection, integral bonds, in particular welding or gluing, are preferably used. The connection can also be achieved by a force fit and/or form fit.

The heat exchanger 2 can be designed in different, not conclusively illustrated, variants according to FIGS. 8*a* to 8*d*.

The heat exchanger 2 according to FIG. 8*a* corresponds to the previously described embodiment, while the heat exchangers 2 according to FIGS. 8*b* to 8*d* differ in the way the second medium B is guided through the jacket 10. The second medium B is guided there repeatedly through the jacket for heat transfer, such repetitions also being referred to as a "pass".

By attaching a deflector cover 18 according to FIG. 8*b*, the second medium B can be deflected in the first end area 14 and guided through the jacket 10 or the jacket space 20 once more. Both the second inlet 31 and the second outlet 32 are located in the second end area 15. Such a heat exchanger 2 is also called a "2-pass".

FIG. 8*c* shows a heat exchanger 2 with a "4-pass". Both in the first end area 14 and in the second end area 15, the second medium B is deflected and passed through the jacket 10 again for the exchange of heat Q.

A so-called "U-tube" is shown in FIG. 8*d*, the tubes 30 of the bundle being U-shaped and leading the second medium B from the second end area 15 to the first end area 14 and back.

FIG. 9*a* shows a further development of a deflection segment 50. In contrast to the previously described deflection segment 50, the deflection segment 50 is formed integrally. In other words: the deflection segment 50 is manufactured as one part. The first partial section 51 and the second partial section 52 are integrally bonded to one another in the pivot axis Y in a first connection area 53. The connection area 53 can be reinforced with corresponding material thickenings in order to have a sufficiently high loadbearing capacity. The one-piece deflection segment 50 or the first partial section 51 and the second partial section 52 can be produced with a primary shaping process or in an additive process, e.g. 3D printing, 3D laser sintering or similar.

The deflection segment 50 according to FIG. 9*a* can have second recesses 72 (not shown) which form the second mating area 70. In the second mating area 70, two integrally formed deflection segments 50 or one integral and one multi-part deflection segment 50 can be fitted together to form a row.

Alternatively, as shown in FIG. 9*b*, a plurality of deflection segments 50 can be integrally formed, it being advantageous if the baffle element 80 is or are also integrally formed with the deflection element 50 or the deflection elements 50. Adjacent deflection elements 50 are connected to one another in a second connection area 54. Alternatively, the entirety of all deflection segments and optionally the baffle plate can be designed as an integral component.

LIST OF REFERENCE NUMERALS

1 Refrigeration system
2 Heat exchanger
3 Compressor
4 Expansion element
10 Jacket
11 First inlet
12 First outlet
14 First end area
15 Second end area
16 Tube base
17 Collector cover
18 Deflector cover
30 Tube
31 Second inlet
32 Second outlet
50 Deflection segment
51 First partial section
52 Second partial section
53 First connection area
54 Second connection area
55 Cut-out
56 Arcuate section
57 Secant section
60 First mating area
62 Recess
65 Angle stop
70 Second mating area
72 Second recess
80 Baffle element
A First medium
B Second medium
D Distance
S Line of symmetry
U Degree of overlap
X Longitudinal axis
Y Pivot axis

The invention claimed is:

1. A heat exchanger, comprising:

a jacket, through which a first medium can flow and which has at least one first inlet and at least one first outlet; and at least one tube, through which a second medium can flow, the tube being guided through the jacket and having at least one second inlet and at least one second outlet, wherein a plurality of deflection segments are arranged in a row in a longitudinal axis in the jacket, wherein each of the deflection segments is formed from at least two partial sections which are arranged so as to overlap and cross, in some areas, transverse to the longitudinal axis, characterized in that the partial sections of each of the deflection segments intersect in a first mating area, and that the first mating area is formed by a recess in at least one of the two partial sections and the first mating area is arranged on the longitudinal axis, and wherein the partial sections of two of the deflection segments which are adjacent in the row intersect in at least one second mating area, the second mating area being formed by at least one second recess in at least one of the partial sections of at least one of the two deflection segments which are adjacent in the row.

2. The heat exchanger (2) according to claim 1, characterized in that the two partial sections (51, 52) are fitted together and/or integrally bonded transverse to the longitudinal axis (X).

3. The heat exchanger (2) according to claim 1, characterized in that the partial sections (51, 52) are arranged at an angle ($\alpha$) relative to a plane perpendicular to the longitudinal axis (X) in opposite directions and, for the angle ($\alpha$), which extends on both sides of the plane between the partial sections (51, 52), $10° \leq \alpha \leq 150°$.

4. The heat exchanger (2) according to claim 3, characterized in that the angle ($\alpha$) between the partial sections (51, 52) of at least two of the deflection segments (50) in the row are different to widen or taper the flow channel through which the first medium flows.

5. The heat exchanger (2) according to claim 1, characterized in that the at least two partial sections (51, 52) overlap with a degree of overlap (U), and that $D/2 \geq U \geq 1$ mm, where D is a distance between diametrical sides as measured transversely to the longitudinal axis (X).

6. The heat exchanger (2) according to claim 1, characterized in that each partial section (51, 52) is a partial section of an oval.

7. The heat exchanger (2) according to claim 1, characterized in that the at least two partial sections (51, 52) of each of the deflection segments (50) are designed with mirror symmetry.

8. The heat exchanger (2) according to claim 1, characterized in that each partial section (51, 52) has a cut-out (55) which is adapted to the at least one tube (30) and through which the tube (30) can be passed.

9. The heat exchanger (2) according to claim 1, characterized in that the jacket (10) has a deflector cover (18) and/or a collector cover (17) at one end area (14, 15).

10. The heat exchanger (2) according to claim 1, characterized in that the at least one first inlet (11) of the jacket (10) is oriented transverse to the longitudinal axis (X), and that the at least one first inlet (11) opens out between the at least two partial sections (51, 52) of a deflection segment (50).

11. The heat exchanger (2) according to claim 1, characterized in that a baffle element (80) is arranged between the longitudinal axis (X) and the at least one first inlet (11).

12. The heat exchanger (2) according to claim 11, characterized in that the baffle element (80) is diamond-shaped in a normal plane.

13. The heat exchanger (2) according to claim 1, characterized in that the partial sections (51, 52) of each of the deflection segments (50) and/or the partial sections (51, 52) of adjacent deflection segments (50) in the row are rigidly connected to one another or form a part.

14. A refrigeration or heating system (1) having the heat exchanger (2) according to claim 1.

15. The heat exchanger (2) according to claim 10, wherein the at least one first inlet (11) is oriented to open out toward the first mating area (60).

* * * * *